US006256797B1

(12) United States Patent
Nemoto et al.

(10) Patent No.: US 6,256,797 B1
(45) Date of Patent: Jul. 10, 2001

(54) HELMET AND METHOD OF REMOVING THE SAME

(75) Inventors: Manabu Nemoto, Kyoto; Masayuki Shida, Chofu, both of (JP)

(73) Assignee: Shoei Co., Ltd., Tokyo (JP)

( * ) Notice: Subject to any disclaimer, the term of this patent is extended or adjusted under 35 U.S.C. 154(b) by 0 days.

(21) Appl. No.: 09/080,674

(22) Filed: May 18, 1998

(30) Foreign Application Priority Data

May 19, 1997 (JP) ..... 9-144642

(51) Int. Cl.[7] ..... A42B 3/10
(52) U.S. Cl. ..... 2/414; 2/421; 2/424
(58) Field of Search ..... 2/410, 411, 414, 2/417, 418, 421, 424, 425

(56) References Cited

U.S. PATENT DOCUMENTS 4,916,759 * 4/1990 Arai ..... 2/414
5,088,129 * 2/1992 Kamata ..... 2/411

FOREIGN PATENT DOCUMENTS 29 52 406 7/1981 (DE) .
0 474 937 3/1992 (EP) .

OTHER PUBLICATIONS

European Search Report, Nov. 19, 1999.

* cited by examiner

*Primary Examiner*—Michael A. Neas
(74) *Attorney, Agent, or Firm*—Hopgood, Calimafde, Judlowe & Mondolino, LLP

(57) ABSTRACT

A helmet having substantially semi-looped pull members and the like which are mounted on inside pads and used to pull out the inside pads from a head protecting cap portion while the helmet is worn on the head of a helmet wearer, and a method of removing the helmet. According to this helmet, the inside pads are pulled out from the head protecting cap portion by pulling the pull members with fingers or the like, thereby removing the head protecting cap portion from the head of the helmet wearer with a relatively small force.

27 Claims, 11 Drawing Sheets

HELMET AND METHOD OF REMOVING THE SAME

BACKGROUND OF THE INVENTION

1. Field of the Invention

This invention relates to a helmet which has a head protecting cap portion worn by the rider of a motor cycle or the like to protect his/her head, the head protecting cap portion having one or a plurality of inside pads on the inside thereof, and to a method of relatively easily removing the helmet from the head.

2. Description of the Invention

A full-face-type helmet has been known. This helmet includes a full-face-type head protecting cap portion worn by the rider of a motor cycle or the like on his/her head, a shield plate capable of opening/closing the window opening formed in the front surface of the head protecting cap portion to oppose the portion between the forehead and chin of the helmet wearer, and chin straps attached to the head protecting cap portion. According to such a full-face-type helmet, almost the entire head of the helmet wearer can be protected by the head protecting cap portion.

The conventional full-face-type helmet having the above structure, however, is not easy to wear and remove from the head of wearer because the head protecting cap portion is also of a full-face type. According to recent full-face-type helmets, to improve the safety of the helmets and feeling of wearing them during a drive, the lower end portion of the head protecting cap portion is narrowed. In addition, it is heightened more to fit the head and face of the wearer due to inside pads for the checks and the like. Owing to this structure, when a helmet wearer, e.g., the rider of a motor cycle, has a traffic accident, a person who takes care of the rider needs a large force to remove the full-face-type head protecting cap portion from the head of the helmet wearer. For this reason, it is considerably difficult for one person to remove the helmet from the wearer.

This point will be described below with reference to FIG. 13. FIG. 13 shows an experiment aimed at measuring the force required to remove a full-face-type helmet 1. A bolt 61 with a ring is attached to the top portion of a head protecting cap portion 2 of a conventional full-face-type helmet 1 worn on the head of a helmet wearer 10. The lower end of a spring balancer 62 is coupled to the bolt 61.

In the state shown in FIG. 13 (the chin straps (not shown) were unfastened from the chin of the wearer 10), the upper end of the spring balancer 62 was pulled upward. In this case, the helmet 1 could not be removed until a tension of 16 kg was applied to the top portion of the head protecting cap portion 2. In contrast to this, when the pair of right and left inside pads for the cheeks were detached from the interior of the head protecting cap portion 2, the helmet 1 could be removed by applying only a tension of 2.5 kg to the top portion of the head protecting cap portion 2.

The experiment shown in FIG. 13 revealed that a large force was usually required to remove the full-face-type helmet 1, and that not so large force was required to remove the full-face-type helmet 1 when the blockish inside pads for the cheeks were detached from the interior of the head protecting cap portion 2.

SUMMARY OF THE INVENTION

The present inventors have made this invention on the basis of the results of the experiment shown in FIG. 13.

It is, therefore, a principal object of the present invention to provide a helmet which allows the head protecting cap portion of the helmet to be removed from the head of a helmet wearer with a relatively small force by relatively easy removing operation even if the helmet is difficult to remove from the head of the helmet wearer.

It is another object of this invention to provide a helmet which allows inside pads to be pulled out from the helmet relatively easily while the helmet is worn on the head of a helmet wearer, but has a good appearance in a normal use state.

It is still another object of the present invention to provide a helmet which allows inside pads to be reliably mounted on a head protecting cap portion, but allows relatively easy disengagement of the pads, thereby further facilitating the removing operation.

In accordance with one aspect of this invention, in the aforementioned helmet, a pull member protruding downwards from at least one of the inside pads is mounted on at least the one of the inside pads to at least partly pull out at least the one of the inside pads from the head protecting cap portion while the helmet is worn.

In accordance with another aspect of this invention, the invention realtes to a method of removing the helmet described above from a head of a helmet wearer. In here, a pull member is mounted on at least one of the inside pads to at least partly pull out at least the one of the inside pads from the head protecting cap portion while the helmet is worn by the wearer; the pull member is pulled to pull out at least the one of the inside pads from the head protecting cap portion at least partly when the helmet worn on the head is to be removed from the head; and the head protecting cap portion is removed from the head of the helmet wearer.

In this invention, it is preferable that the pull member comprises a string-like member having two end portions fixed to each of the inside pads so as to be spaced apart from each other by an appropriate distance in such a state that the member hangs in a substantially semi-looped form. Further, it is preferable that the tape material is formed into a flat, substantially U-shaped member by folding the material at positions near one end portion and the other end portion thereof.

Moreover, both folding angles of the tape material at the two positions are preferable to fall within a range of about 60° to about 120°, and much preferable to fall within a range of about 75° to about 105°. Further, a width of the tape material is preferable to fall within a range of about 2 cm to about 12 cm, and much preferable to fall within a range of about 4 cm to about 9 cm.

In this invention, it is preferable that the pull member is substantially red. Further, a distance between two ends of the substantially semi-looped portion of said pull member is preferable to fall within a range of about 2 cm to about 8 cm, and much preferable to fall within a range of about 3 cm to about 6 cm. Moreover, a total length of the substantially semi-looped portion of the pull member is preferable to be larger than the distance between the two ends of the substantially semi-looped portion by a value falling within a range of about 0.3 cm to about 6 cm, and it is much preferable to be larger than the distance between the two ends of the substantially semi-looped portion by a value falling within a range of about 0.5 cm to about 4 cm. Besides, two ends of the substantially semi-looped portion of the pull member are preferable to be located on an outer surface of at least one of the inside pads at a position between a lower end of the inside pad and a level higher than the lower end by about 15 mm, and are much preferable to be located on an outer surface of at least one of said inside pads at a position between a level higher than a lower end of said inside pad by about 2 mm and a level higher than the lower end by about 8 mm.

In this invention, it is preferable that the one or plurality of inside pads include an inside pad for a left cheek and an inside pad for a right cheek, and the pull member is mounted on each of the pair of left and right inside pads. Further, it is preferable that at least the one inside pad is mounted on the head protecting cap portion by using one or a plurality of mounting mechanisms, and at least one of the mounting mechanisms comprises an engaged stud formed on one of at least the one inside pad and the head protecting cap portion, an engaging aperture formed in the other to be fitted on the engaged stud, and an operating member which is operated to move one of the engaged stud and the engaging aperture relative to the other so as to disengage the engaged stud from said engaging aperture. Besides, it is preferable that the engaged stud is integrally formed with said operating member.

In this invention, it is preferable that there are sandwiching member mounted on said head protecting cap portion, and a sandwiched member mounted on at least one of said inside pads and held by said sandwiching member at least partly, and an engaged step portion formed on the sandwiched member is engaged with an engaging end portion formed on the sandwiching member.

The above, and other, objects, features and advantages of this invention, will become easily apparent from the following detailed description thereof which is to be read in connection with the accompanying drawings.

DESCRIPTION OF THE PREFERRED EMBODIMENTS

First Embodiment

The first embodiment in which this invention is applied to a full-face-type helmet will be described first with reference to FIGS. 1 to 10.

Figure 1:
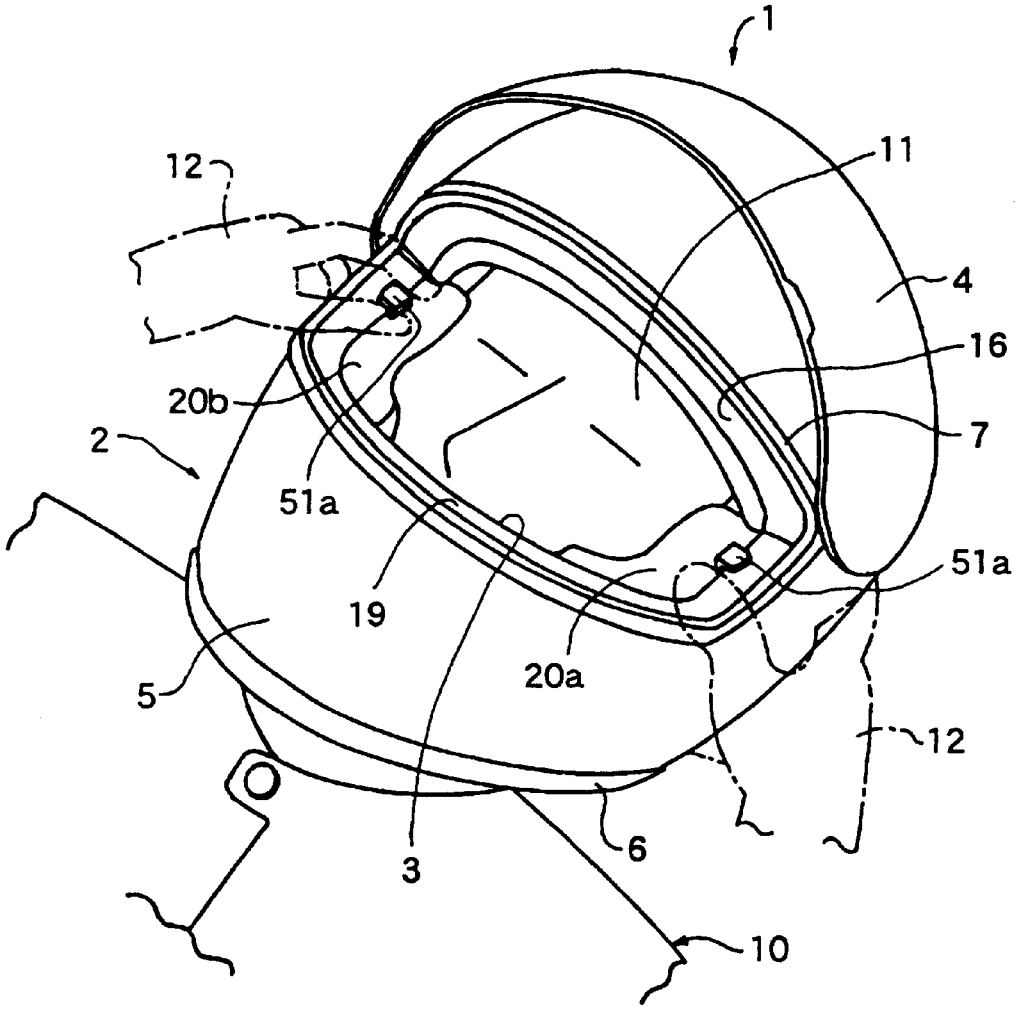
FIG. 1 is an overall perspective view of a helmet in a worn state in the first embodiment in which this invention is applied to a full-face-type helmet.
Figure 10:
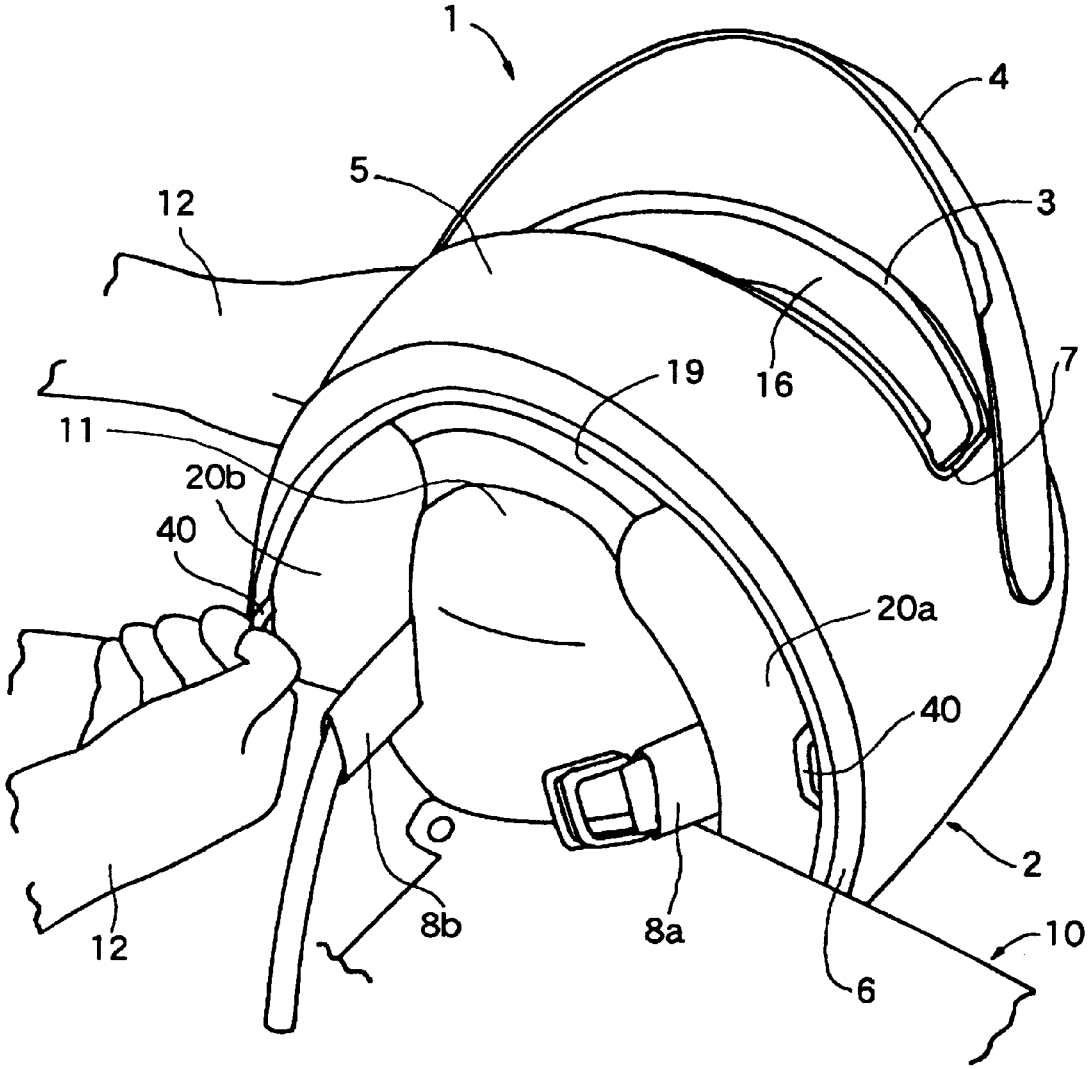
FIG. 10 is an overall perspective view of the helmet in FIG. 1 in a worn state, showing the process of removing the blockish inside pads for the cheeks from the impact-on-the-chin-and-cheek absorbing liner.

As shown in FIGS. 1 and 10, a full-face-type helmet 1 is made up of a full-face-type head protecting cap portion 2, a shield plate 4 and a pair of right and left chin straps 8*b* and 8*a* (see FIG. 10). Note that the head protecting cap portion 2 is to be worn on a head 11 of a helmet wearer (to be referred to as a wearer hereinafter) 10, e.g., the rider of a motor cycle. The shield plate 4 is capable of opening/closing a window opening 3 formed in the front surface of the head protecting cap portion 2 to oppose the portion (i.e., the face) between the forehead and chin of the wearer 10. The chin straps 8*a* and 8*b* are attached to the interior of the head protecting cap portion 2.

As has been known, the shield plate 4 is made of a transparent or translucent, hard material such as polycarbonate or another type of hard synthetic resin.

The shield plate 4 is pivotally mounted on the head protecting cap portion 2 with a pair of right and left mounting screws (not shown). The shield plate 4 closes the window opening 3 at the backward pivoting position, and opens the window opening 3 at the forward pivoting position in FIGS. 1 and 10 at which the shield plate 4 pivots upward from the backward pivoting position. At the intermediate position between these positions, the shield plate 4 can partly open the window opening 3. As has been known, one or a plurality of types of ventilator mechanisms may be incorporated in the head protecting cap portion 2, as needed, although a description and illustration thereof will be omitted.

Figure 2:
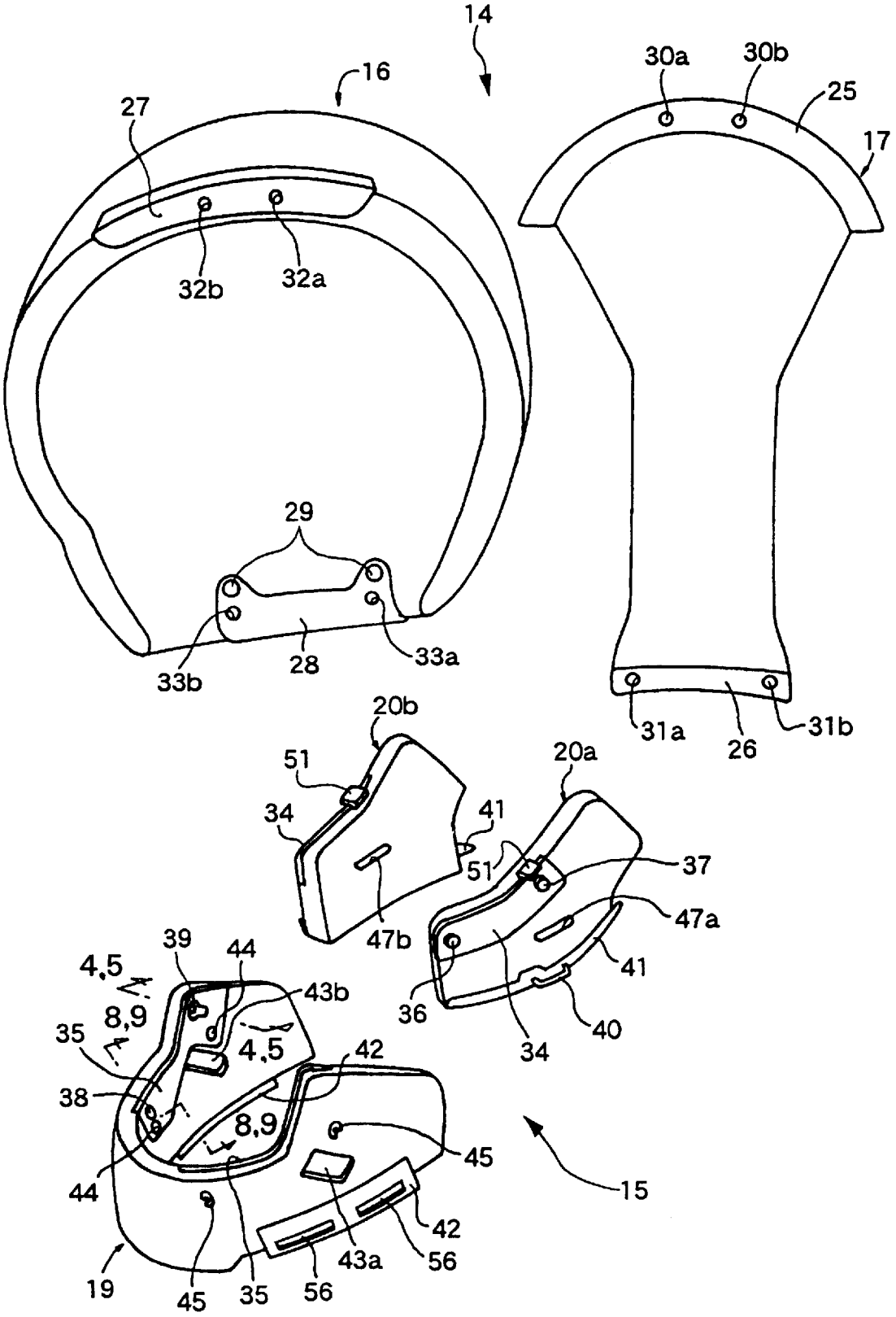
FIG. 2 is an exploded perspective view of backing members, of the helmet in FIG. 1, which are used each for the head, and for the chin and cheeks.

As shown in FIGS. 1, 2 and 10, the head protecting cap portion 2 is made up of a full-face-type outer shell 5, a lower rim member 6 having a substantially U-shaped cross-section, a rim member 7 for the window opening, which has a substantially E-shaped cross-section, a backing member 14 for the head and a backing member 15 for the chin and cheeks. Note that the outer shell 5 forms the circumferential wall of the head protecting cap portion 2. The lower rim member 6 is fixed to the outer shell 5 throughout the lower end of the outer shell 5 with an adhesive or the like. In addition, the rim member 7 is fixed to the outer shell 5 throughout the circumference of the window opening 3 with an adhesive or the like. The backing member 14 is fixed to the outer shell 5 with an adhesive or the like in contact with the inner surface of the outer shell 5 in a front head region, a top head region, right and left side head regions, a back head region respectively corresponding to the front part, top part, right and left parts and back part of the head of the wearer 10. The backing member 15 is fixed to the outer shell 5 with an adhesive or the like in contact with the inner surface of the outer shell 5 in chin and cheek regions respectively corresponding to the chin and cheeks of the wearer 10.

The outer shell 5 can be made of a composite material. More specifically, the outer shell 5 can be formed by lining the inner surface of a strong shell body made of a hard synthetic resin, e.g., FRP, with a flexible sheet such as an unwoven fabric. The lower rim member 6 can be made of a soft synthetic resin such as expanded vinyl chloride or synthetic rubber. The rim member 7 can be made of an elastic material with high flexibility such as synthetic rubber.

As shown in FIG. 2, the backing member 14 is constituted by an impact-on-the-head absorbing liner 16 and a breathing backing cover 17 for the head. Note that the backing cover 17 is attached to the impact-on-the-head absorbing liner 16 so as to cover almost the entire inner surface of the impact-on-the-head absorbing liner 16 except for the right and left side head regions corresponding to the right and left parts of the head of the wearer 10. FIG. 2 shows a rear view of only the backing cover 17. As shown in FIG. 2, the backing member 15 is constituted by an impact-on-the-chin-and-cheek absorbing liner 19 and a pair of right and left blockish inside pads 20*b* and 20*a* for the cheeks. The inside pads 20*a* and 20*b* are attached to the impact-on-the-chin-and-cheek absorbing liner 19 in contact with the inner surface of the impact-on-the-chin-and-cheek absorbing liner 19 in right and left cheek regions corresponding to the right and left cheeks of the wearer 10.

Each of the body portions of the impact-on-the-head absorbing liner 16 and the impact-on-the-chin-and-cheek absorbing liner 19 can be made of a material with appropriate rigidity and plasticity such as expanded polystyrene or another synthetic resin. The body portion of the backing cover 17 can be made of a porous unwoven fabric obtained by laminating a layer consisting of an elastic material with high flexibility such as expanded urethane or another synthetic resin, on the surface (i.e., the outer surface) opposing the impact-on-the-head absorbing liner 16. Each of the body portions of the pair of inside pads 20*a* and 20*b* can be made up of one or a plurality of elastic materials with high flexibility such as expanded urethane or another synthetic resin, and a porous unwoven fabric covering the inner and outer surfaces of the elastic material in the form of a bag.

As shown in FIG. 2, a front-side engaged member 25 and a rear-side engaged member 26 are respectively fixed to the front and rear end portions of the body portion of the backing cover 17 with a sewing thread, a tape, an adhesive or the like. A front-side engaging member 27 and a rear-side engaging member 28 are respectively fixed to the front and rear end portions of the body portion of the impact-on-the-head absorbing liner 16 with rivets 29, washers (not shown) and the like, or with an adhesive, a tape or the like to almost oppose these engaged members 25 and 26. A pair of engaged studs 30*a* and 30*b* and a pair of engaged studs 31*a* and 31*b* respectively formed on the engaged members 25 and 26 on the backing cover 17 side are press-fitted in a pair of engaging apertures 32*a* and 32*b* and a pair of engaging apertures 33*a* and 33*b* respectively formed in the engaging members 27 and 28 on the impact-on-the-head absorbing liner 16 side, thereby detachably mounting the backing cover 17 on the impact-on-the-head absorbing liner 16. Note that the engaged members 25 and 26 and the engaging members 27 and 28 can be made of a soft synthetic resin such as polyethylene.

The engaged stud 30*a* is fitted in the engaging aperture 32*a* to form a first mounting mechanism for mounting the front end portion of the backing cover 17 on the front end portion of the impact-on-the-head absorbing liner 16. In addition, the engaged stud 30*b* is fitted in the engaging aperture 32*b* to form a second mounting mechanism similar to the above mechanism. The engaged stud 31*a* is fitted in the engaging aperture 33*a* to form a first mounting mechanism for mounting the rear end portion of the backing cover 17 on the rear end portion of the impact-on-the-head absorbing liner 16. The engaged stud 31*b* is fitted in the engaging aperture 33*b* to form a second mounting mechanism similar to the above mechanism.

Figure 3:
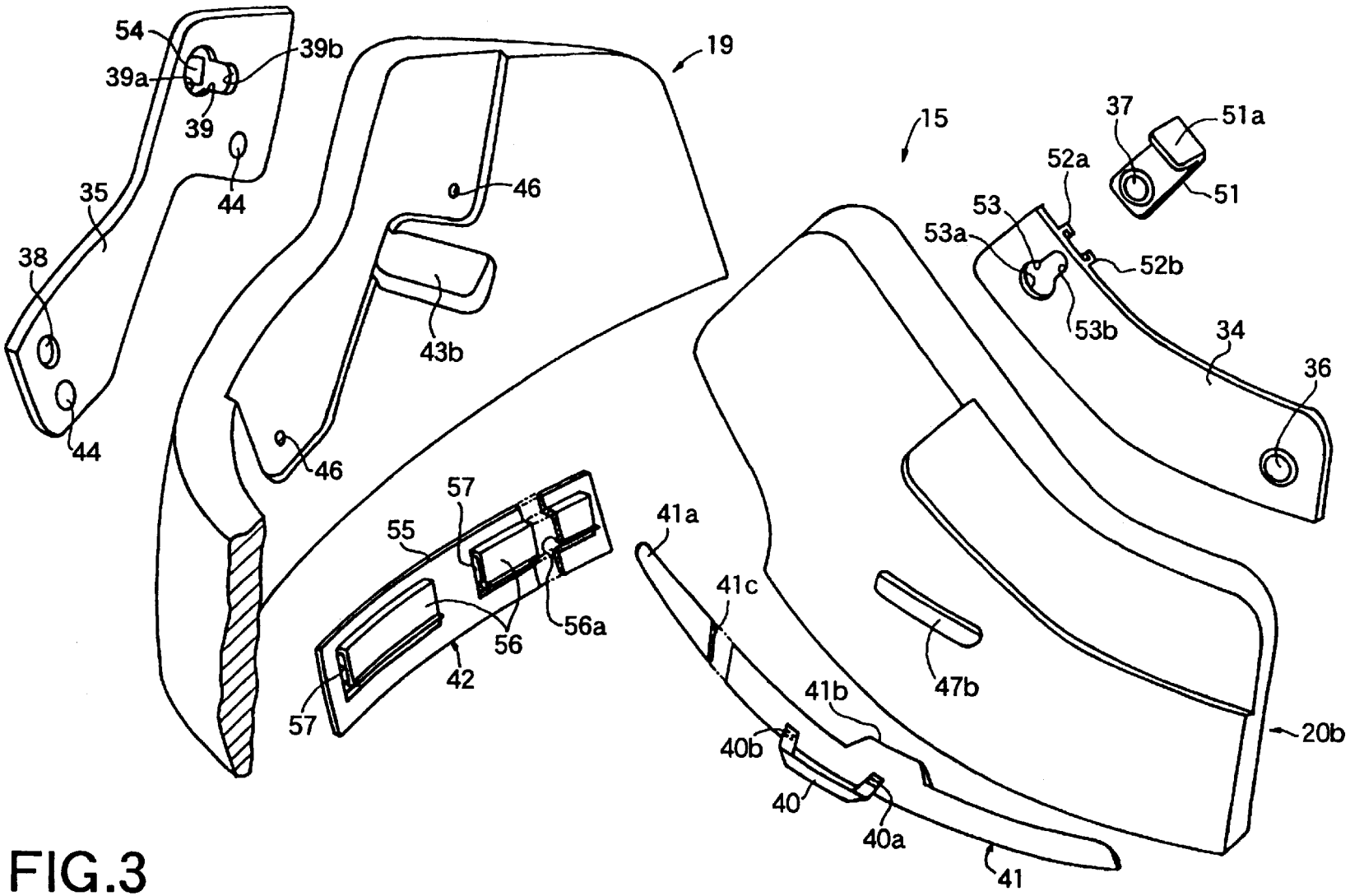
FIG. 3 is a partially cutaway exploded perspective view of the left half of the backing members, of the helmet in FIG. 1, which are used for the chin and cheeks.
Figure 4:
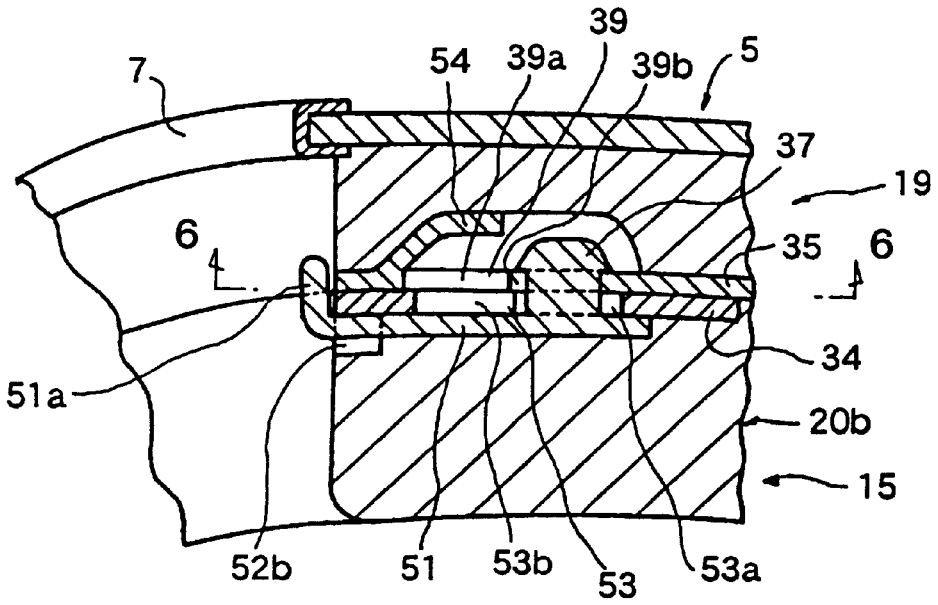
FIG. 4 is a sectional view taken along a line A—A in FIG. 2, showing a state in which an impact-on-the-chin-and-cheek absorbing liner and a blockish inside pad for the cheek are mounted.

As shown in FIGS. 2 and 3, a pair of right and left engaged members 34 are fixed to portions near the upper ends of the outer surfaces of the body portions of the blockish inside pads 20*a* and 20*b* for the cheeks with a sewing thread, a tape, an adhesive or the like. A pair of right and left engaging members 35 are fixed to portions near the upper end portions of the right and left inner surface portions of the body portion of the impact-on-the-chin-and-cheek absorbing liner 19 with rivets 44, washers 45 and the like, or with an adhesive, a tape or the like to almost oppose the engaged members 34. Through holes 46 are formed in the body portion of the impact-on-the-chin-and-cheek absorbing liner 19 to allow the rivets 44 to extend therethrough. The pairs of engaged studs 36 and 37 respectively formed on the engaged members 34 on the inside pads 20*a* and 20*b* side are press-fitted in pairs of engaging apertures 38 and 39 respectively formed in the engaging members 35 on the impact-on-the-chin-and-cheek absorbing liner 19 side , thereby detachably mounting the inside pads 20*a* and 20*b* on the impact-on-the-chin-and-cheek absorbing liner 19. Note that the engaged members 34 on the pair of right and left inside pads 20*b* and 20*a* and the pair of right and left engaging members 35 on the impact-on-the-chin-and-cheek absorbing liner 19 can be made of a soft synthetic resin such as polyethylene.

A first mounting mechanism for mounting the inside pads 20*a* and 20*b* on the impact-on-the-chin-and-cheek absorbing liner 19 is formed by fitting the engaged studs 36 in the engaging apertures 38. A second mounting mechanism similar to the above mechanism is formed by fitting the engaged studs 37 in the engaging apertures 39.

Of the pairs of engaged studs 36 and 37 formed on the engaged members 34 on the inside pads 20*a* and 20*b*, the engaged studs 36 are integrally formed with the engaged members 34. The remaining engaged studs 37 are integrally formed on the distal end portions of operating members 51, which are substantially L-shaped slide levers. Each operating member 51 is slidably fitted in a pair of right and left guide grooves formed on each engaged member 34 by a pair of right and left holding portions 52*b* and 52*a* integrally formed with the engaged member 34 and having L-shaped cross-sections. Stud engaging apertures 53 are respectively formed in the pair of right and left engaged members 34. Each stud engaging aperture 53 has a large-diameter inserting portion 53*a* having a diameter large enough to insert the engaged stud 37 therein and a small-diameter disengaging portion 53*b* having a diameter large enough to move the engaged stud 37 inserted in the stud engaging aperture 53. The inserting portion 53*a* and the disengaging portion 53*b* communicate with each other in the form of a keyhole. Note that the proximal end portion of each operating member 51 has a bent portion because the operating member 51 is L-shaped, and the bent portion forms an operating tap 51*a* of the operating member 51.

Of the pairs of engaging apertures 38 and 39 respectively formed in the pair of right and left engaging members 35 on the impact-on-the-chin-and-cheek absorbing liner 19, the engaging apertures 38 are formed into almost circles, almost squares or the like to allow the engaged studs 36 on the inside pads 20*a* and 20*b* to be detachably press-fitted therein.

In contrast to this, each of the remaining engaging apertures 39 has a large-diameter disengaging part 39*a* having a diameter large enough to remove the engaged stud 37 from the engaging aperture 39 and a small-diameter engaging part 39*b* required to lock the engaged stud 37 inserted in the engaging aperture 39. The disengaging part 39*a* and the engaging part 39*b* communicate with each other in the form of a keyhole. A removal guide arm 54 having a substantially arcuated cross-section is integrally formed on the outer surface of each engaging member 35 to oppose the disengaging part 39*a*.

As shown in FIGS. 2 and 3, a pair of right and left sandwiched members 41 are fixed to the lower end portions of the body portions of the inside pads 20*b* and 20*a* with a sewing thread, a tape, an adhesive or the like. A pair of right and left sandwiching members 42, each having a folded structure, are respectively fixed to the right and left lower end portions of the body portion of the impact-on-the-chin-and-cheek absorbing liner 19 with an adhesive or tape or with rivets, washers and the like. The pair of right and left sandwiched members 41 are inserted into the sandwiching members 42 having the folded structures from below to be sandwiched and supported. Note that the sandwiched members 41 on the pair of right and left inside pads 20*b* and 20*a* and the pair of right and left sandwiching members 42 on the impact-on-the-chin-and-cheek absorbing liner 19 can be made of a soft synthetic resin such as polyethylene.

Pull members 40 used to pull the inside pads 20*a* and 20*b* from the head protecting cap portion 2 are mounted on the sandwiched members 41 on the inside pads 20*a* and 20*b*. In the embodiment shown in FIG. 2, the pull members 40 are mounted on the sandwiched members 41 on the inside pads 20*a* and 20*b* by positioning two end portions 40*a* and 40*b* of a relatively thin tape-like fabric string (i.e., a tape material) of each pull member 40 at an appropriate distance from each other in almost the horizontal direction and sewing them on each sandwiched member 41 in an almost parallel state in the vertical direction.

Each pull member 40 is therefore a semi-looped plastic member. Near the end portion 40*a*, each pull member 40 is folded outward at a predetermined angle when viewed from the end portion 40*a*. Near the end portion 40*b*, the pull member 40 is further folded outward at a predetermined angle when viewed from the end portion 40*b*. As a result, the pull member 40 is formed into a substantially U-shaped, flat member as a whole. In the embodiment shown in FIG. 2, both the two predetermined angles are almost 90°. From the viewpoint of practicality, both the angles preferably fall within the range of about 60° to about 120°, and more preferably the range of about 75° to about 105°. For this reason, the pull members 40 are arranged, in a slightly loose state, near the lower end portions of the outer surfaces of the inside pads 20*a* and 20*b*. Since the pull members 40 slightly protrude downward from the lower end faces (i.e., the lower end portions) of the inside pads 20*a* and 20*b*, the pull members 40 are hardly seen from the outside while the wearer 10 is wearing the helmet in a normal state. The pull member 40 and the sandwiched member 41 constitute a looped portion on which a person can put his/her finger.

The pull members 40 are preferably fixed to the lower end portions of the inside pads 20*a* and 20*b* or portions near the lower end portions. However, the pull members 40 need not always be fixed to the sandwiched members 41. The pull members 40 may be fixed to other members mounted on the inside pads 20*a* and 20*b* or directly fixed to the body portions of the inside pads 20*a* and 20*b*. In addition, the pull members 40 preferably have a color (e.g., substantially red) clearly different from the colors of other surrounding members (i.e., the body portions of the inside pads 20*a* and 20*b*, the sandwiched members 41, the body portion of the impact-on-the-chin-and-cheek absorbing liner 19, the sandwiching members 42 and the like) to allow a person to clearly recognize the positions of the pull members 40 when he/she begins to pull them.

In the embodiment shown in FIG. 2, the distance between the two ends of the semi-looped portion (i.e., the portion excluding the end portions 40*a* and 40*b* fixed to the inside pads 20*a* and 20*b*) of each pull member 40 is about 4 cm. From the viewpoint of practicality, this distance preferably falls within the range of about 2 cm to about 8 cm, and more preferably the range of about 3 cm to about 6 cm. In the embodiment shown in FIG. 2, the length of the semi-looped portion of each pull member 40 is larger than the above distance between the two ends by about 1 cm to have a slack of about 1 cm. From the viewpoint of practicality, however, the above difference preferably falls within the range of about 0.3 cm to about 6 cm, and more preferably the range of about 0.5 cm to about 4 cm. In the embodiment shown in FIG. 2, the tape width of each pull member 40 is about 6 mm. From the viewpoint of practicality, however, this width preferably falls with in the range of about 2 mm to about 12 mm, and more preferably the range of about 4 mm to about 9 mm.

The positions of two ends of the semi-looped portion of each pull member 40 in the vertical direction may be set on the lower end face of a corresponding one of the inside pads 20*a* and 20*b* or near the lower end face. In the embodiment shown in FIG. 2, the two ends of each semi-looped portion are positioned on the outer surface of a corresponding one of the inside pads 20*a* and 20*b* at a level higher than the lower end face by about 4 mm. From the viewpoint of practicality, however, these two ends are preferably positioned between the lower end face and a level higher than the lower end face by about 15 mm, and more preferably between a level higher than the lower end face by about 2 mm and a level higher than lower end face by about 8 mm. However, this invention need not be limited to these numerical values as long as the pull members 40 are not noticeable much from the outside and a person can put his/her fingers on the pull members 40 while the helmet is worn by a user. Therefore, each tape-like pull member 40 preferably protrudes downward from the lower end face (i.e., the lower end portion of the head protecting cap portion 2) by about the tape width (i.e., about 6 mm in the embodiment shown in FIG. 2) or a width slightly larger than the tape width (preferably about 2 mm to about 20 mm, and more preferably about 4 mm to about 10 mm). Each pull member 40 need not have a tape-like shape and may have a plastic rod-like or string-like shape. In this case, each pull member 40 preferably has a thickness (i.e., a diameter) of about 0.5 mm to about 6 mm, and more preferably about 2 mm to about 4 mm.

As shown in FIG. 3, each of the sandwiched members 41 on the inside pads 20*a* and 20*b* has an elongated, thin, platelike shape. The rear ends of the sandwiched members 41 integrally protrude backward from the inside pads 20*a* and 20*b* to form inserted portions 41*a*. The intermediate portions of the sandwiched members 41 integrally protrude upward to form positioned portions 41*b*. An engaged step portion 41*c* is integrally formed on the upper end of the inner surface of each sandwiched member 41 almost throughout almost its total length.

As shown in FIG. 3, each of the pair of right and left sandwiching members 42 on the impact-on-the-chin-and-cheek absorbing liner 19 is constituted by an outer platelike portion 55 and a pair of right and left inner platelike portions 56. These platelike portions 55 and 56 constitute a folded structure. A pair of right and left window openings 57 are formed in the outer platelike portion 55. The upper ends of the inner platelike portions 56 are integrally coupled to the outer platelike portion 55 such that the inner platelike portions 56 oppose the pair of window openings 57. An engaging end protrusion 56*a* is integrally formed on the lower end of the inner surface of each inner platelike portion 56 almost throughout its total length.

Figure 8:
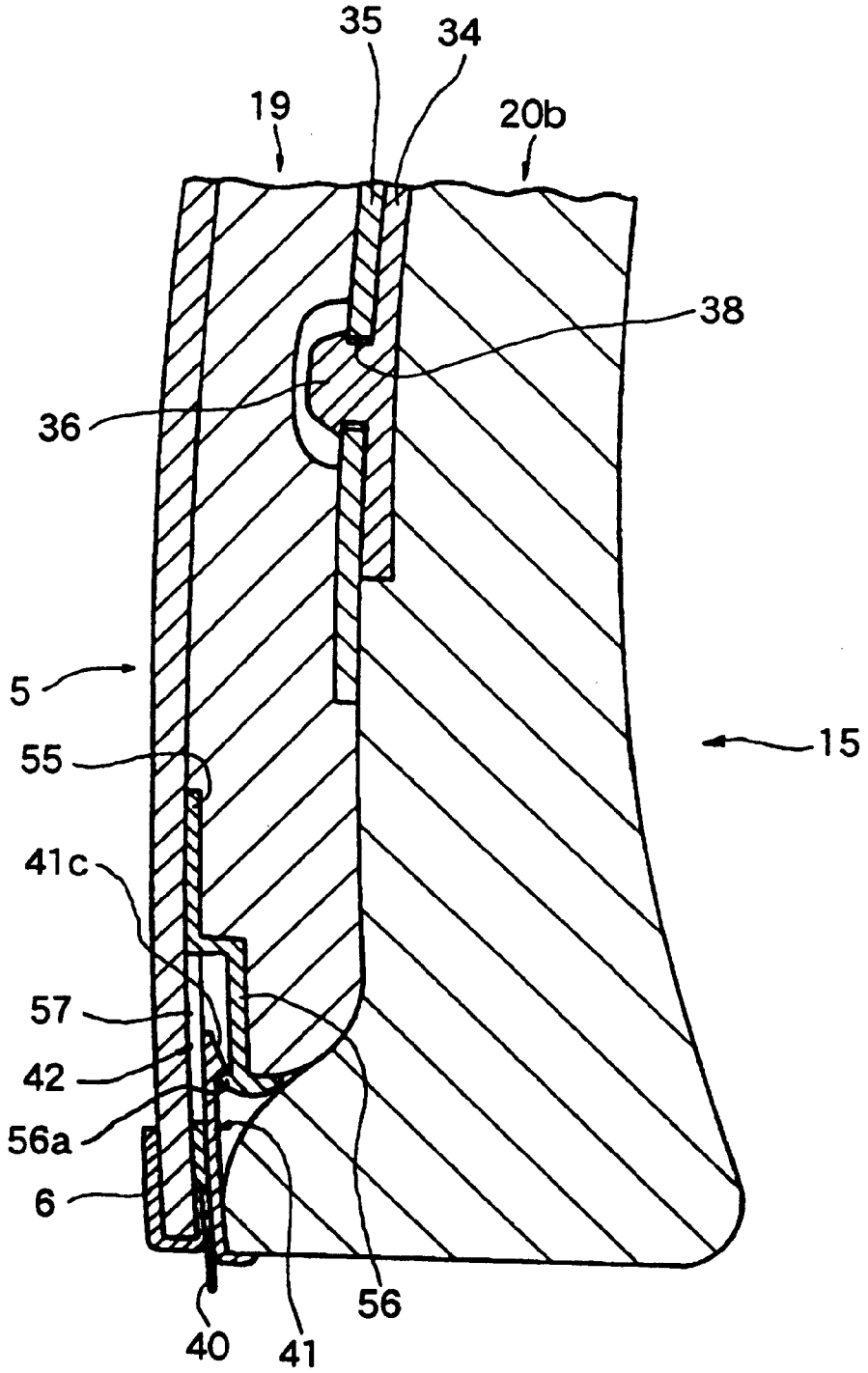
FIG. 8 is a sectional view taken along a line D—D in FIG. 2, showing a state in which the impact-on-the-chin-and-cheek absorbing liner and the blockish inside pad for the cheek are mounted on an outer shell.

The sandwiched members 41 are inserted between the outer platelike portions 55 and the inner platelike portions 56 of the sandwiching members 42. The engaged step portions 41*c* of the sandwiched members 41 are engaged with the engaging end protrusions 56*a* of the inner platelike portions 56, as shown in FIG. 8. In this case, the positioned portion 41*b* of the sandwiched member 41 is inserted between the pair of right and left inner platelike portions 56 of the sandwiching member 42 to be positioned by the pair of inner platelike portions 56. In addition, the inserted portion 41*a* of the sandwiched member 41 is inserted between the rear-side engaging member 28 of the impact-on-the-head absorbing liner 16 and the rear-side engaged member 26 of the backing cover 17 to be positioned by the rear-side engaging members 28 and 26.

A pair of through apertures 43*b* and 43*a* which allow the pair of right and left chin straps 8*b* and 8*a* having proximal ends mounted on the outer shell 5 with screws or the like to extend therethrough are formed in the right and left side portions of the impact-on-the-chin-and-cheek absorbing liner 19. A pair of through holes 47*a* and 47*b* are respectively formed in the inside pads 20*a* and 20*b*. The pair of chin straps 8*a* and 8*b* extending through the pair of through apertures 43*a* and 43*b* further extend through through holes 47*a* and 47*b* and reach the interior of the head protecting cap portion 2.

In the state shown in FIG. 1, in which the wearer 10 is wearing the full-face-type helmet 1 in FIGS. 1 to 10, which has the above structure, a person other than the wearer 10 (e.g., a person who takes care of the rider having a motor cycle accident) can remove the helmet from the head 11 of the wearer 10 in the following steps (a) to (e).

(a) First of all, the person disengages the pair of right and left chin straps 8*a* and 8*b* from each other, as shown in FIG. 10.

Figure 5:
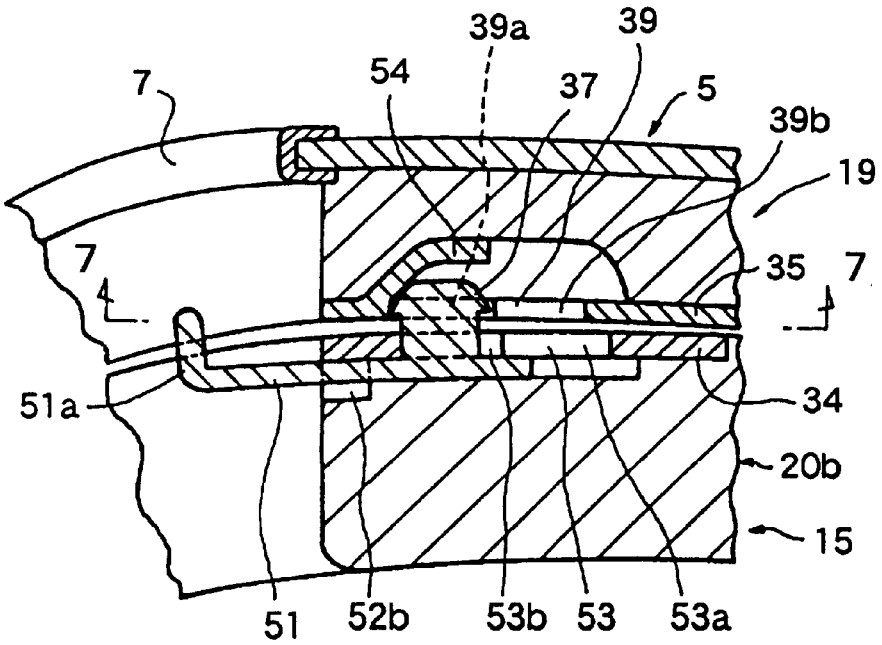
FIG. 5 is a sectional view taken along the line A—A in FIG. 2, showing the process of removing the blockish inside pad for the cheek from the impact-on-the-chin-and-cheek absorbing liner.
Figure 6:
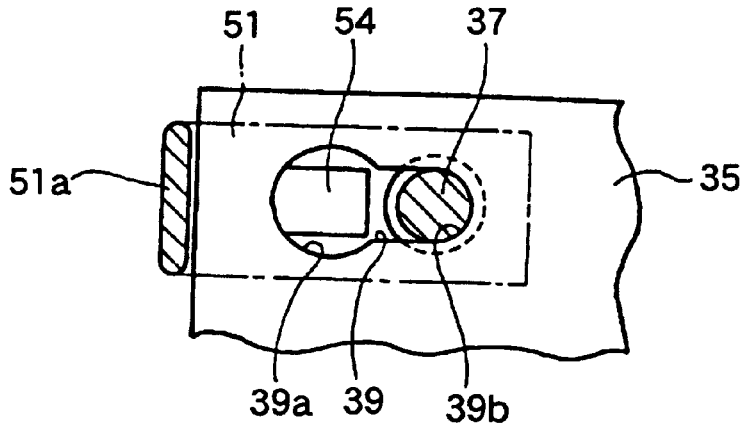
FIG. 6 is a sectional view taken along a line B—B in FIG. 4.
Figure 7:
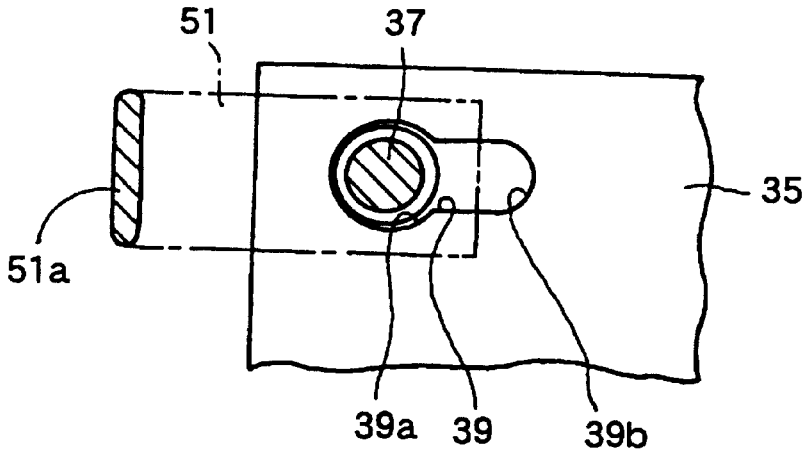
FIG. 7 is a sectional view taken along a line C—C in FIG. 5.

(b) As shown in FIG. 1, the person then holds and pulls the operating taps 51*a* of the operating members 51 of the pair of right and left inside pads 20*b* and 20*a* simultaneously or separately with fingers of hands 12. Alternatively, the person levers each operating tap 51a forward from the state shown in FIG. 4 to the state shown in FIG. 5 with a coin or the like in contact with the inner surface of the operating tap 51*a*. In this case, the engaged stud 37 formed on each operating member 51 moves from the fixing position in FIG. 6 (i.e., the state in which the engaged stud 37 is press-fitted in the engaging part 39*b* of the engaging aperture 39) to the releasing position in FIG. 7 (i.e., the state in which the engaged stud 37 is loosely inserted in the disengaging part 39*a* of the engaging aperture 39 to be released from the fitted state). As shown in FIG. 5, therefore, the engaged stud 37 is guided by the inner surface of the removal guide arm 54 of the engaging member 35 to be slightly removed from the engaging aperture 39. As a result, the inside pads 20*a* and 20*b* are slightly lifted inward from the impact-on-the-chin-and-cheek absorbing liner 19.

(c) In the state shown in FIG. 1, the person inserts the thumbs or the like of the hands 12 between the impact-on-the-chin-and-cheek absorbing liner 19 and the inside pads 20*a* and 20*b* separately or simultaneously to pull the inside pads 20*a* and 20*b* apart from the impact-on-the-chin-and-cheek absorbing liner 19 at positions near the engaged studs 36 of the engaged members 34 to some extent. In this case, the engaged studs 36 press-fitted in the engaging apertures 38 of the engaging members 35 as shown in FIG. 8 are removed from the engaging apertures 38, as indicated by the chain line in FIG. 9.

Figure 9:
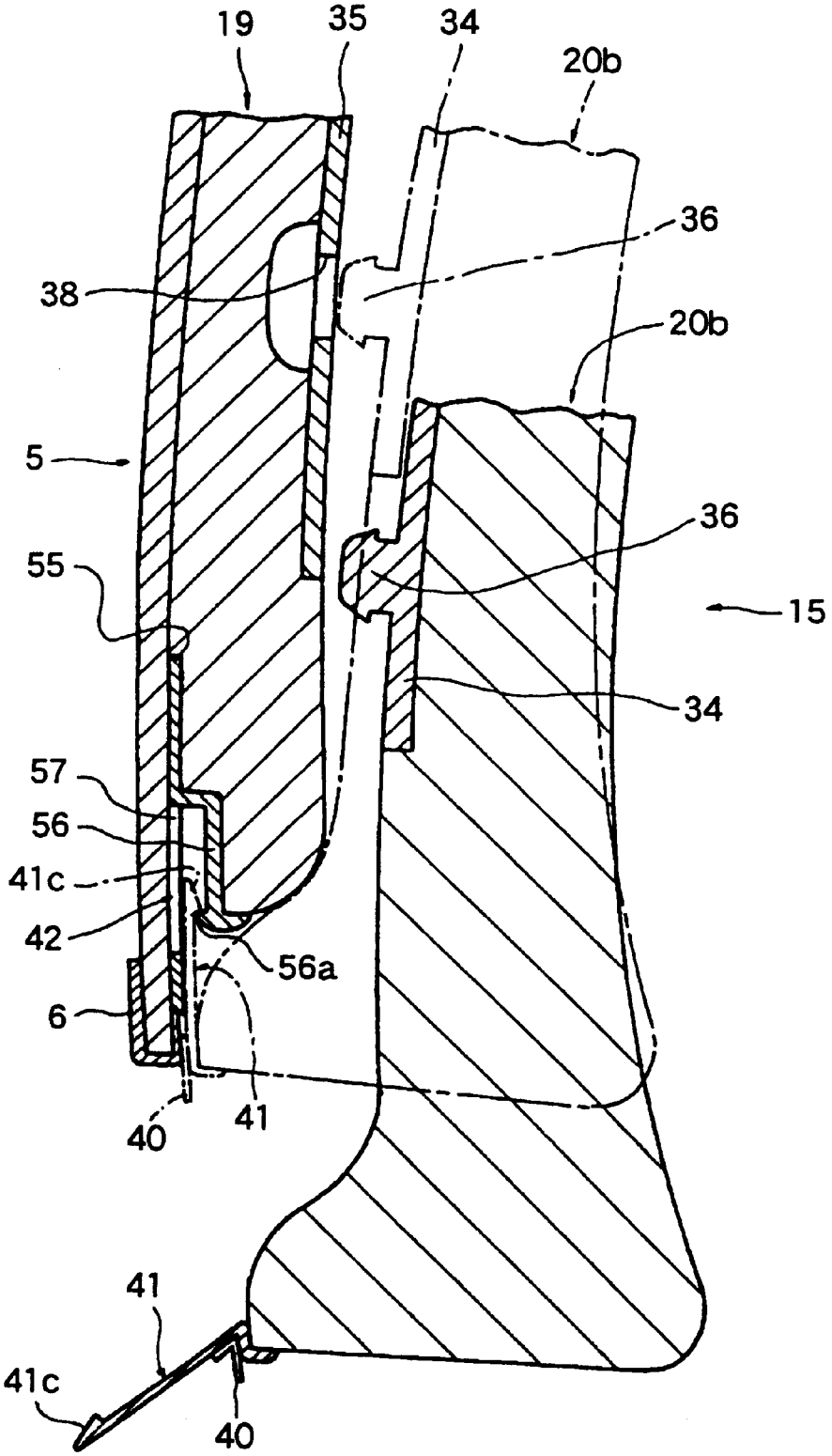
FIG. 9 is a sectional view taken along the line D—D in FIG. 2, showing the process of removing the blockish inside pad for the cheek from the impact-on-the-chin-and-cheek absorbing liner.

(d) As shown in FIG. 10, the person separately or simultaneously holds the semi-looped pull members 40 of the inside pads 20*a* and 20*b* with fingers of the hands 12, and pulls them downward. As a result, the inside pads 20*a* and 20*b* shown in FIG. 5 and indicated in chain lines in FIG. 9 are pulled out from the impact-on-the-chin-and-cheek absorbing liner 19 and removed from the head protecting cap portion 2 through the state indicated by the solid line in FIG. 9. In this case, by simply pulling each pull member 40 in the above manner, the engaged step portion 41*c* of the sandwiched member 41 is forcibly pulled apart from the engaging end protrusion 56*a* of the inner platelike portion 56 of the sandwiching member 42, and the inserted portion 41*a* of the sandwiched member 41 is forcibly removed from between the rear-side engaging member 28 of the impact-on-the-head absorbing liner 16 and the rear-side engaged member 26 of the backing cover 17. The inside pads 20*a* and 20*b* can be pulled out from the head protecting cap portion 2 at once by pulling the pull members 40 with a certain force or more. If the engaged step portions 41*c* and the engaging end portions 56*a* are not formed, the inside pads 20*a* and 20*b* can be gradually pulled out from the head protecting cap portion 2 by pulling the pull members 40. Therefore, after partly pulling out the inside pads 20*a* and 20*b* by pulling the pull members 40, the person may hold the body portions of the inside pads 20*a* and 20*b* or the sandwiched members 41 instead of the pull members 40 to pull out the remaining parts of the inside pads 20*a* and 20*b*. Alternatively, the remaining parts may be left without being pulled out.

(e) The person holds the head protecting cap portion 2 with the hands 12 and separates it from the head 11 of the wearer 10. In this case, since the inside pads 20*a* and 20*b* are partly or completely pulled out from the head protecting cap portion 2, the head protecting cap portion 2 can be easily removed from the head 11 of the wearer 10.

In the steps (a) to (e), both the right and left inside pads 20*b* and 20*a* are pulled out. Even if, however, one of the right and left inside pads 20*b* and 20*a* is completely or partly pulled out, the head protecting cap portion 2 can be removed from the head 11 of the wearer 10 with relative ease. The inside pads 20*a* and 20*b* can be mounted on the interior of the head protecting cap portion 2 by handling the respective members in a reverse order to that described above in the steps (b) to (d). When the step (d) is to be reversely executed, however, since the head 11 of the wearer 10 is not present in the head protecting cap portion 2, the person can hold the inside pads 20*a* and 20*b* with his/her hand and bring them into contact with the inner surface of the impact-on-the-chin-and-cheek absorbing liner 19. In addition, the steps (a) and (b) can be partly or completely executed by the wearer 10 himself/herself.

Second Embodiment

The second embodiment in which this invention is applied to a full-face-type helmet will be described next with reference to FIGS. 11 and 12.

A helmet 1 according to the second embodiment has substantially the same structure as that of the helmet 1 according to the first embodiment in FIGS. 1 to 10 except that a second mounting mechanism formed by press-fitting an engaged stud 37 in an engaging aperture 39 is of a fixed type like a first mounting mechanism constituted by an engaged stud 36 and an engaging aperture 38 and has substantially the same structure as that of the first mounting mechanism. The above description about the helmet 1 according to the first embodiment in FIGS. 1 to 10 therefore applies to the helmet 1 according to the second embodiment in FIGS. 11 and 12 except for portions associated with the above difference. The same reference numerals in the second embodiment denote the same parts as in the first embodiment, and a description thereof will be omitted.

Figure 12:
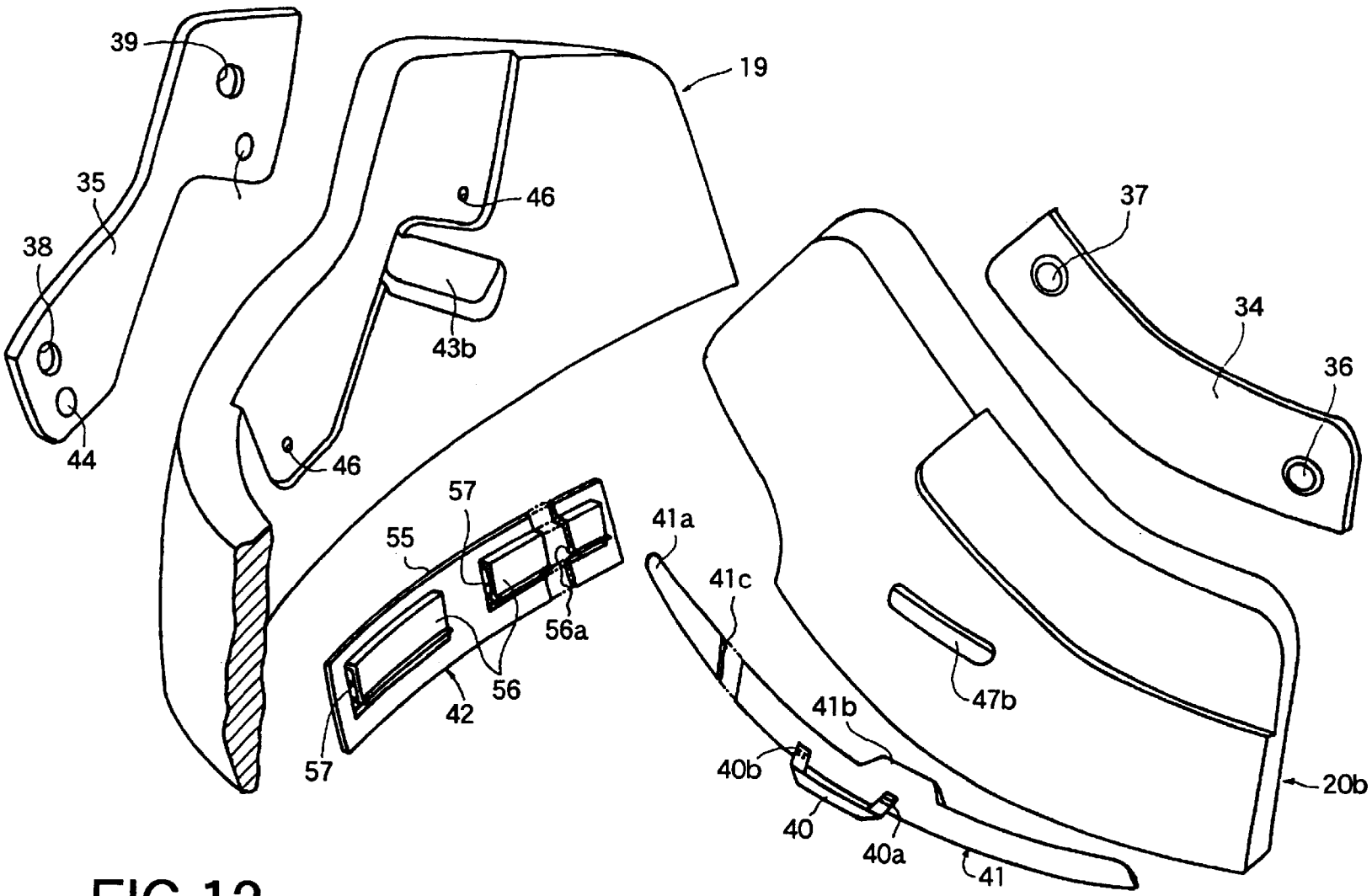
FIG. 12 is a partially cutaway exploded perspective view of the left halves of the backing members, of the helmet in FIG. 11, which are used for the chin and cheeks.
Figure 13:
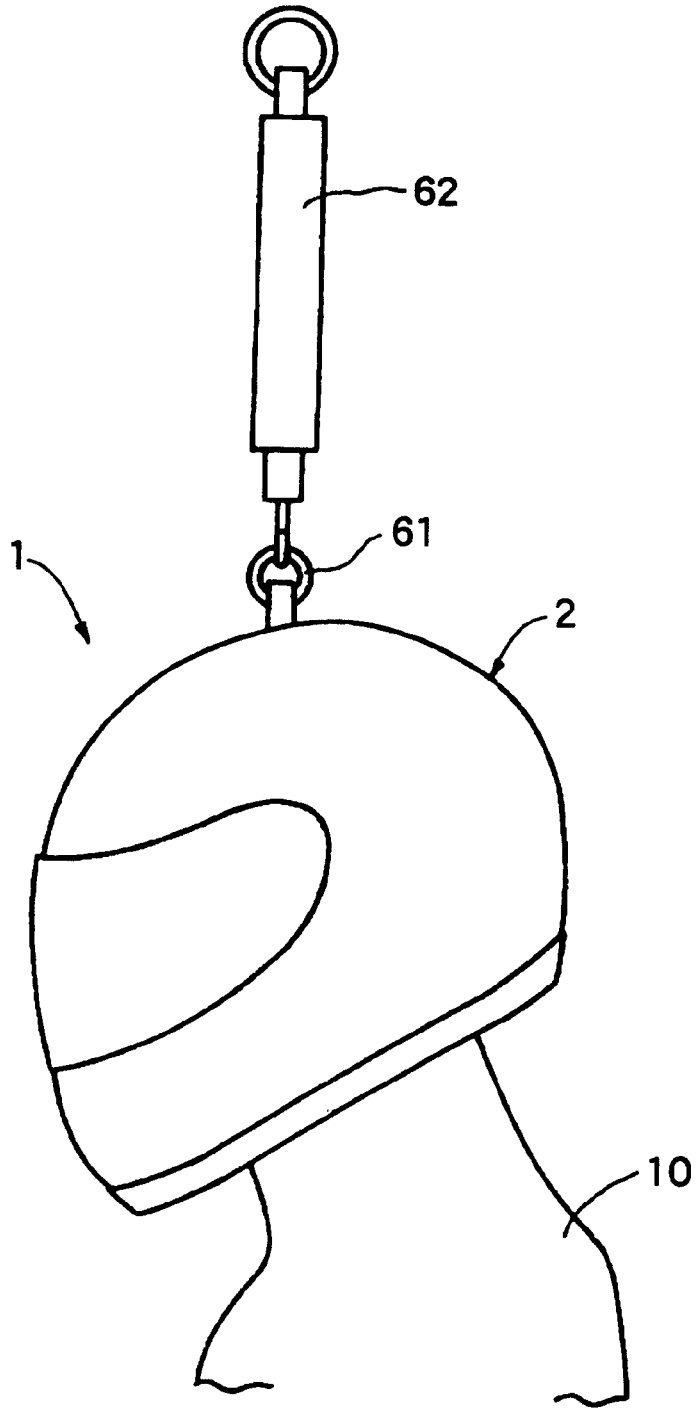
FIG. 13 a right side view showing an experiment aimed at measuring the force required to remove a full-face-type helmet from the head of a wearer.

In the second embodiment, therefore, as shown in FIG. 12, the engaged studs 37 of a pair of right and left engaged members 34 are integrally formed with the engaged members 34, similar to the engaged studs 36. The engaging apertures 39 of a pair of right and left engaging members 35 are formed into almost circles, almost square or the like, similar to the engaging apertures 38, to allow the engaged studs 37 to be detachably press-fitted therein.

Figure 11:
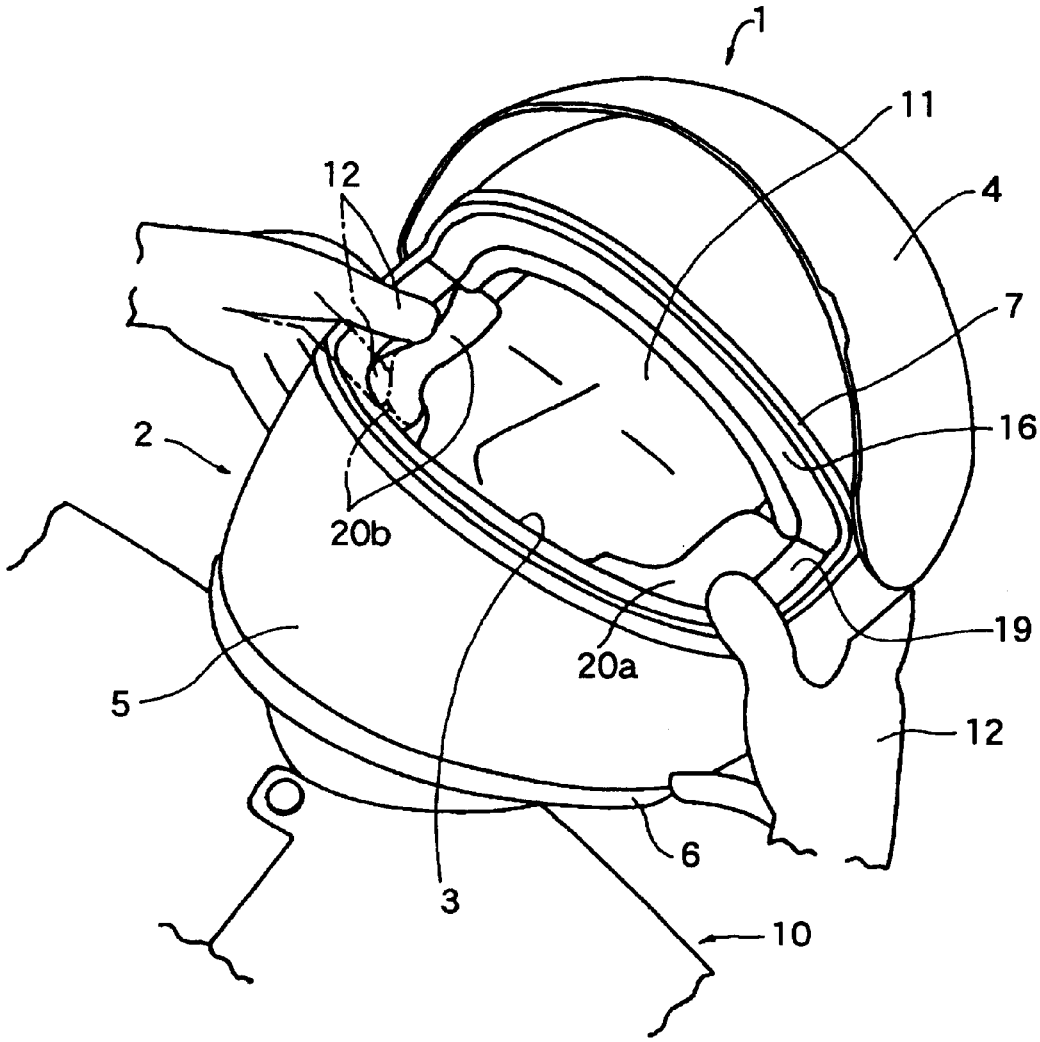
FIG. 11 is an overall perspective view of a helmet in a worn state in the second embodiment in which this invention is applied to a full-face-type helmet.

According to the second embodiment, in the state shown in FIG. 11, in which a wearer 10 is wearing the full-face-type helmet 1 in FIGS. 11 and 12, a person who takes care of the wearer 10 can remove the helmet 1 from a head 11 of the wearer 10 according to a process in which the step (b) of the steps (a) to (e) in the first embodiment is replaced with the step (b)' similar to the step (c).

(b)' As indicated by the solid lines in FIG. 11, the person inserts the thumbs or the like of hands 12 between an impact-on-the-chin-and-cheek absorbing liner 19 and blockish inside pads 20*a* and 20*b* for the cheeks separately or simultaneously, and pulls the inside pads 20*a* and 20*b* apart from the impact-on-the-chin-and-cheek absorbing liner 19 at positions near the engaged studs 37 of the engaged members 34. In this case, the engaged studs 37 press-fitted in the engaging apertures 39 of the engaging members 35 as in the case shown in FIG. 8 are pulled out from the engaging apertures 39 as in the case indicated by the chain line in FIG. 9.

In the second embodiment, the step (c) may be executed before the step (b)'. The thumb of the hand 12 which is indicated by the chain line in FIG. 11 indicates the execution of the step (c).

Having described specific preferred embodiments of this invention with reference to the accompanying drawings, it is to be understood that the invention is not limited to that precise embodiments, and that various changes and modifications may be effected therein by one skilled in the art without departing from the scope or spirit of the invention as defined in the appended claims.

For example, in the first and second embodiments described above, the pull members 40 are fixed to the inside pads 20*a* and 20*b* with the two end portions 40*a* and 40*b* of each pull member 40 being spaced apart from each other by an appropriate distance substantially in the horizonal direction, thereby forming the pull members 40 into the semi-looped members. However, the two end portions 40*a* and 40*b* of each pull member 40 may be fixed to almost the same portion of a corresponding one of the inside pads 20*a* and 20*b* such that each pull member 40 itself is formed into almost a loop. In this case, the length of the looped portion of each pull member 40, the positions of the two ends of the looped portion (with respect to the lower end portion of each of the inside pads 20*a* and 20*b*) in the vertical direction, and the length by which each pull member 40 protrudes downward from the lower end portion can be set almost equal to those in the first embodiment. In this case, however, the semi-looped portions in the first embodiment are replaced with the looped portions in the second embodiment. Each pull member 40 need not have a semi-looped or looped shape. The pull members 40 may extend substantially downward with their upper end portions being fixed to the inside pads 20*a* and 20*b* (and more specifically, the sandwiched members 41). In this case, the lower end portion of each pull member 40 or a portion near the lower end portion is preferably sewed on its intermediate portion to form a looped portion. Alternatively, each pull member 40 is preferably formed into a substantially inverted T-shaped member as a whole by fixing a flexible finger grip bar consisting of a soft synthetic resin such as polyethylene and extending almost horizontally to the lower end portion of each pull member 40 or a portion near the lower end portion. In this case as well, the length by which each pull member 40 protrudes downwards from the lower end portion of each of the inside pads 20*a* and 20*b* can be set almost equal to that in the first embodiment.

In the first and second embodiments described above, the first and second mounting mechanisms constituted by the engaged studs 36 and 37 and the engaging apertures 38 and 39 are used to mount the inside pads 20*a* and 20*b* on the impact-on-the-chin-and-cheek absorbing liner 19. However, either or both of the first and second mounting mechanisms can be omitted. When both the mounting mechanisms are omitted, the steps (b) and (c) of the steps (a) to (e) described above can be omitted by mounting the inside pads 20*a* and 20*b* on the impact-on-the-chin-and-cheek absorbing liner 19 using inserting mechanisms constituted by the sandwiched member 41 and the sandwiching member 42 or the like. The process of removing the helmet 1 can be greatly simplified.

In the first and second embodiments described above, the sandwiched members 41 are respectively mounted on the inside pads 20*a* and 20*b*, and the pair of right and left sandwiching members 42 are mounted on the impact-on-the-chin-and-cheek absorbing liner 19. In contrast to this, sandwiching members similar to the sandwiching member 42 may be mounted on the inside pads 20*a* and 20*b*, and a pair of right and left sandwiched members similar to the sandwiched members 41 may be mounted on the impact-on-the-chin-and-cheek absorbing liner 19.

In the first and second embodiments described above, the engaged studs 30*a*, 30*b*, 31*a*, 31*b*, 36 and 37 are formed on the backing cover 17 and the inside pads 20*a* and 20*b* and the engaging apertures 32*a*, 32*b*, 33*a*, 33*b*, 38 and 39 are formed in the impact-on-the-head absorbing liner 16 and the impact-on-the-chin-and-cheek absorbing liner 19. The positional relationships between arbitrary some (i.e., an arbitrary number) or all of these engaged studs and engaging apertures may be reversed.

In the first embodiment described above, the first mounting mechanism on the lower front side, which is constituted by the engaged stud 36 and the engaging aperture 38, is of the fixed type, and the second mounting mechanism on the upper rear side, which is constituted by the engaged stud 37 and the engaging aperture 39, is of the movable type. However, both the first and second mounting mechanisms may be formed as movable type mechanisms with the operating members 51. Alternatively, the first mounting mechanism on the lower front side may be formed as a movable type mechanism with the operating member 51, and the second mounting mechanism on the upper rear side may be formed as a fixed type mechanism.

In the first and second embodiments described above, this invention is applied to the full-face-type helmets 1. However, this invention can also be applied to other types of helmet such as a jet type helmet and a semi-jet type helmet.

What is claimed is:

1. A helmet including a head protecting cap portion, an opening defined by a lower rim by which said helmet is placed on a wearer's head, said cap portion having at least one inside pad arranged and mounted therein, wherein: a pull member is attached to and protrudes downward from said at least one inside pad for at least partly pulling out said at least one inside pad from said head protecting cap portion through said opening defined by said lower rim while said helmet is worn, and said pad being releasably mounted effective for removal through said opening, wherein: said pull member comprises a string-like member having two end portions which are fixed to said inside pad so as to be spaced apart from each other by an appropriate distance in such a state that said string-like member hangs in a substantially semi-looped form.

2. A helmet according to claim 1, wherein: said string-like member comprises a tape material, said tape material being formed into a flat, substantially U-shaped member by folding said material at positions near one end portion and the other end portion thereof.

3. A helmet according to claim 2, wherein: a folding angle formed between each of two folded portions and an unfolded portion of said tape material folded at the two positions fills within a range of about 60° to about 120 °.

4. A helmet according to claim 3, wherein: each of the folding angles formed between each of two folded portions and an unfolded portion of said tape material folded at the two positions falls within a range of about 75° to about 105 °.

5. A helmet according to claim 2, wherein: a width of said tape material falls within a range of about 2 mm to about 12 mm.

6. A helmet according to claim 5, wherein: the width of said tape material falls within a range of about 4 mm to about 9 mm.

7. A helmet according to claim 1, wherein: said pull member is substantially red.

8. A helmet according to claim 1 wherein: a distance between two ends of the substantially semi-looped portion of said pull member falls within a range of about 2 cm to about 8 cm.

9. A helmet according to claim 7, wherein: the distance between the two ends of the substantially semi-looped portion of said pull member falls within a range of about 3 cm to about 6 cm.

10. A helmet according to claim 1 wherein: a total length of the substantially semi-looped portion of said pull member is larger than the distance between the two ends of the substantially semi-looped portion by a value falling within a range of about 0.3 cm to about 6 cm.

11. A helmet according to claim 10, wherein: a total length of the substantially semi-looped portion of said pull member is larger than the distance between the two ends of the substantially semi-looped portion by a value falling within a range of about 0.5 cm to about 4 cm.

12. A helmet according to claim 1 wherein: the two ends of the substantially semi-looped portion of said pull member are located on an outer surface of said at least one inside pad at a position between a lower end of said at least one inside pad and a level higher than the lower end by about 15 mm.

13. A helmet according to claim 12, wherein: the two ends of the substantially semi-looped portion of said pull member are located on an outer surface of said at least one inside pad at a position between a level higher than a lower end of said at least one inside pad by about 2 mm and a level higher than the lower end by about 8 mm.

14. A helmet according to claim 1, wherein: said at least one of inside pads includes an inside pad for a left cheek and an inside pad for a right cheek, and said pull member is mounted on at least one of said left and right inside pads.

15. A helmet according to claim 1, wherein said at least one inside pad is mounted on said head protecting cap portion by using at least one mounting mechanism, and wherein said at least one mounting mechanism comprises an engaged stud formed on one of said at least one inside pad and said head protecting cap portion, an engaging aperture formed in the other to be fitted on said engaged stud, and an operating member which is operated to move one of said engaged stud and said engaging aperture relative to the other so as to disengage said engaged stud from said engaging aperture.

16. A helmet according to claim 15, wherein: said engaged stud is integrally formed with said operating member.

17. A helmet according to claim 15, wherein: said string-like pull member comprises a string-like member having two end portions which are fixed to said inside pad so as to be spaced apart from each other by an appropriate distance in such a state that said string-like member hangs in a substantially semi-looped form.

18. A helmet according to claim 17, wherein: said sting-like member comprises a tape material, said tape material being formed into a flat, substantially U-shaped member by folding said material at positions near one end portion and the other end portion thereof.

19. A helmet according to claim 18, wherein: each of the folding angles formed between each of two folded portions and an unfolded portion of said tape material folded at the two positions falls within a range of about 75° to about 105 °.

20. A helmet according to claim 18, wherein: the width of said tape material falls within a range of about 4 cm to about 9 cm.

21. A helmet according to claim 17, wherein: said pull member is substantially red.

22. A helmet according to claim 17, wherein: the distance between the two ends of the substantially semi-looped portion of said pull member falls within a range of about 3 cm to about 6 cm.

23. A helmet according to claim 17, wherein: a total length of the substantially semi looped portion of said pull member is larger than the distance between the two ends of the substantially semi-looped portion by a value falling within a range of about 0.5 cm to about 4 cm.

24. A helmet according to claim 17, wherein: the two ends of the substantially semi-looped portion of said pull member are located on an outer surface of said at least one inside pad at a position between a level higher than a lower end of said at least one inside pad by about 2 mm and a level higher than the lower end by about 8 mm.

25. A helmet according to claim 17, wherein: said at least one of inside pads includes an inside pad for a left cheek and an inside pad for a right cheek, and said pull member is mounted on at least one of said left and right inside pads.

26. A helmet according to claim 15, wherein: a sandwiching member mounted on said head protecting cap portion, and a sandwiched member mounted on said at least one inside pad and held by said sandwiching member at least partly, are further included, and wherein an engaged step portion formed on said sandwiched member is engaged with an engaging end portion formed on said sandwiching member.

27. A helmet according to claim 1, wherein: a sandwiching member mounted on said head protecting cap portion, and a sandwiched member mounted on said at least one inside pad and held by said sandwiching member at least partly, are further included, and wherein an engaged step portion formed on said sandwiched member is engaged with an engaging end portion formed on said sandwiching member.

* * * * *